United States Patent [19]

Lane

[11] 4,425,754

[45] Jan. 17, 1984

[54] SPINNING MACHINE INFORMATION GATHERING APPARATUS AND METHOD

[75] Inventor: John E. Lane, Littleton, Mass.

[73] Assignee: Parks-Cramer Company, Fitchburg, Mass.

[21] Appl. No.: 77,930

[22] Filed: Sep. 24, 1979

[51] Int. Cl.[3] ..... D01H 13/32

[52] U.S. Cl. ..... 57/265; 57/81; 57/264; 340/518; 340/521; 340/720

[58] Field of Search ..... 57/264, 265, 80, 81; 340/870.41, 517, 518, 524, 525, 520, 521, 366 CA, 748, 752, 720

[56] References Cited

U.S. PATENT DOCUMENTS

| | | | |
|---|---|---|---|
| Re. 27,501 | 10/1972 | Bryan, Jr. et al. | 57/265 |
| 3,523,413 | 8/1970 | Ford et al. | 57/81 X |
| 3,680,298 | 8/1972 | Saunders | 57/81 X |
| 4,001,785 | 1/1977 | Miyazaki et al. | 340/518 X |
| 4,136,511 | 1/1979 | Raasch | 57/265 |
| 4,194,349 | 3/1980 | Lane | 57/265 |

*Primary Examiner*—John Petrakes

*Attorney, Agent, or Firm*—Bell, Seltzer, Park & Gibson

[57] ABSTRACT

An identification detector and cooperating identification encoder generate an identification signal uniquely correlated to a specific individual one of a group of ring spinning machines which are traversed by at least one traveling unit.

12 Claims, 6 Drawing Figures

SPINNING MACHINE INFORMATION GATHERING APPARATUS AND METHOD

FIELD AND BACKGROUND OF INVENTION

It has been proposed heretofore that information regarding the operating conditions of a group of ring spinning machines in a textile mill be gathered for use in tending such machines and more efficiently managing the manufacture of yarns by such machines. For example, it has been disclosed in such prior patents as Ford et al U.S. Pat. No. 3,523,413; Bryan, Jr. et al U.S. Pat. No. Re. 27,501 and Saunders U.S. Pat. No. 3,680,298, owned in common with the present invention, that at least one traveling unit be supported for travel along a predetermined path of travel for traversing one or more ring spinning machines and that information be gathered from detectors traveling with such a traveling unit. To the extent that the disclosures of the aforementioned patents are necessary or appropriate to an understanding of the present invention, those prior patents are hereby incorporated by reference into the present description. As will be apparent to persons skilled in the applicable arts from a study of the aforementioned patents, a data system may be provided in connection with a group of ring spinning machines which is responsive to detectors on a traveling unit for determining the condition of each machine of a traversed group of machines.

While information gathering and processing apparatus and methods of the types described in the aforementioned patents have achieved some acceptance in textile mill operations, there has existed a continuing problem of assuring proper correlation of information gathered with the specific individual machine from which the information is taken or to which the information relates. Some prior arrangements have suggested a resolution of this problem by providing only a single traveling unit for a single specific individual machine, as is illustrated for example in the specific disclosure of Bryan, Jr. et al U.S. Pat. No. Re. 27,501. An alternative approach, employed where a traveling unit is shared over a number of spinning machines as in Ford et al U.S. Pat. No. 3,523,413 and Saunders U.S. Pat. No. 3,680,298, provides a program in a processor forming a portion of a data system which is intended to distinguish movement of the traveling unit from one spinning machine to another and, by updating a register, maintain a record of which specific individual machine is under traversal. By means of such an updated register, data gathered from a specific individual machine is properly sorted and taken into account.

As the development of such information gathering apparatus and methods has proceeded, it has been realized that difficulties and deficiencies are encountered by these two prior approaches. First, where an individual traveling unit is assigned to a specific individual machine, a relatively greater number of traveling units is required to successfully accomplish monitoring of a specific number of spinning machines, thus substantially increasing the original cost and later maintenance requirements for the information gathering system. Where an updated register is employed to identify the specific individual machine being traversed at any given time, the register conceivably can "lose track" of the traveling unit and inaccurately determine the specific individual machine being traversed. Once such an inaccuracy in determination occurs, records accumulated over an extended interval of time lose any positive value and may, indeed, become decidedly disadvantageous.

BRIEF DESCRIPTION OF INVENTION

With the above discussion in mind, it is an object of the present invention to facilitate correct correlation of information gathered with a traversed ring spinning machine to which the information relates. In realizing this object of the present invention, an identification detector is mounted on a traveling unit of movement therewith and for originating and transmitting to a data system machine identification signals. An identification encoder is mounted in predetermined relation to a corresponding traversed machine for scanning traversal of the encoder by the detector. The identification detector and identification encoder cooperate, upon scanning traversal of the encoder by the detector, for generating an identification signal which is uniquely correlated to a specific individual machine.

Yet a further object of the present invention is to accomplish unique identification of a specific individual machine, in the context of gathering information from ring spinning machines, by a binary coded pattern of actuation of electrical switch devices. Such a binary coded pattern, as described more fully hereinafter, permits a variation of identification signals which enlarges the capability of a particular traveling unit to gather information from a substantial number of spinning machines. Further, such generation of an identification signal opens the possibility of indicating, within the binary coded pattern, the direction of movement of the traveling unit relative to the specific individual machine.

BRIEF DESCRIPTION OF FIGURES

Some of the objects of the invention having been stated, other objects will appear as the description proceeds, when taken in connection with the accompanying drawings, in which.

DETAILED DESCRIPTION OF INVENTION

While the present invention will be described hereinafter with particular reference to the accompanying drawings, it is to be understood at the outset of the following description that persons skilled in the arts applicable to the present invention will be enabled by this disclosure to construct apparatus and practice methods which embody the present invention and yet take forms which may differ from those here particularly described and shown. Accordingly, the description which follows is to be understood broadly as an enabling disclosure directed to persons skilled in the appropriate arts, and is not to be taken as being restrictive upon the scope of the present invention.

Figure 1:
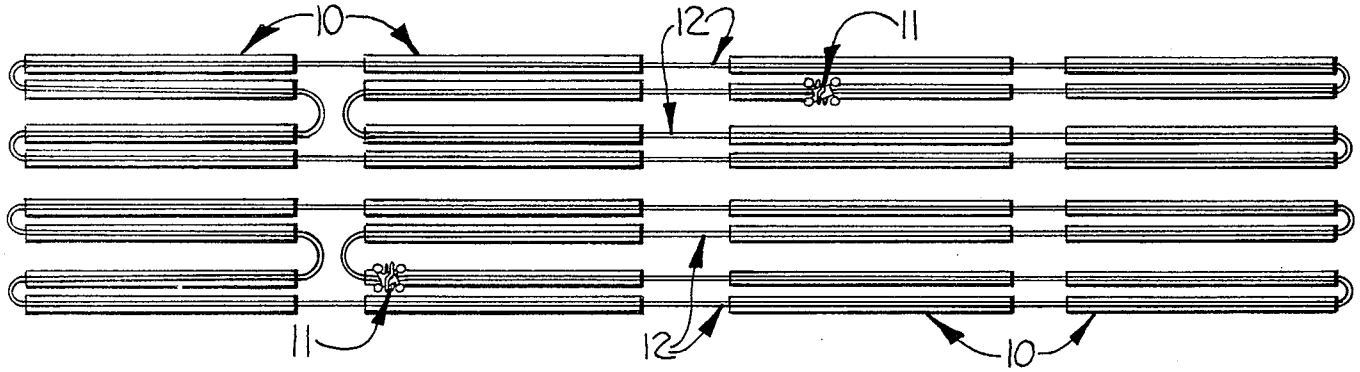
FIG. 1 is a plan view of a textile mill room showing an installation of an apparatus in accordance with the present invention, as associated with the plurality of ring spinning machines.
Figure 2:
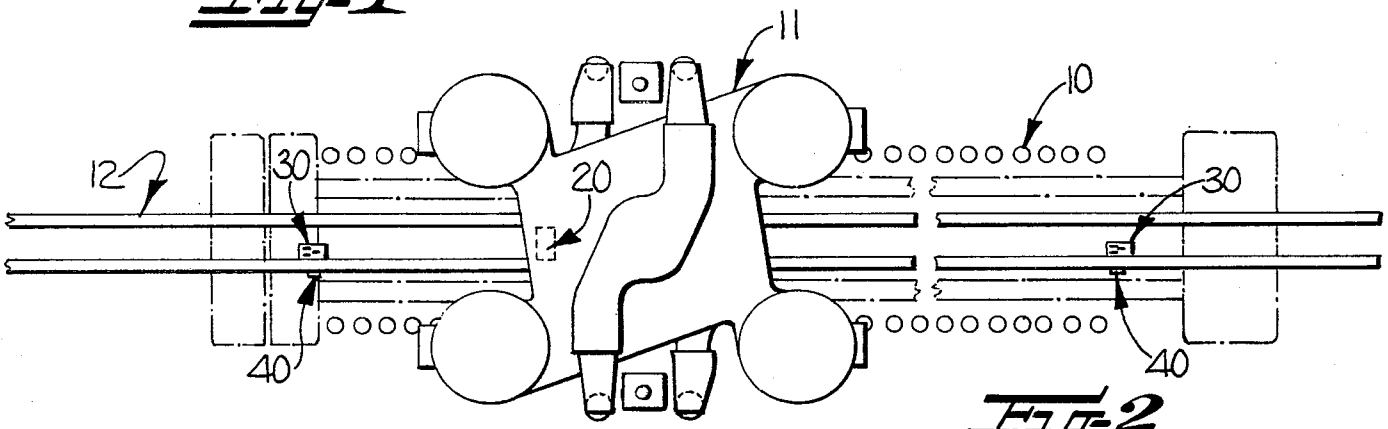
FIG. 2 is an enlarged plan view of one ring spinning machine and one traveling unit in accordance with the present invention.

Referring now more particularly to the drawings, the present invention is contemplated as being particularly useful in connection with a plurality of ring spinning machines, certain of which are generally indicated at 10 (FIG. 1), arranged in a plurality of rows in a textile mill. One or more traveling units, one of which is generally indicated at 11 in FIGS. 1 and 2, are supported for traversing the textile machines 10 along predetermined paths of travel. In the drawings, and consistent with the disclosures of the aforementioned related prior patents, the traveling units 11 are substantially identical to the fourth embodiment disclosed in U.S. Pat. No. 3,304,571 owned in common with the present invention. As disclosed in that patent, each of the traveling units 11 is supported for movement along a track 12 extending above the spinning machines 10. Conventionally, such a track describes a closed pattern of so-called H-loop configuration (FIG. 1). Each traveling unit includes drive means driving it in movement along the track so as to traverse the machines in a circuit automatically and at predetermined intervals.

The ring spinning machines 10 include elements or operating instrumentalities (not shown) for receiving strand material in a form known as roving, drawing or attenuating the strand material, and twisting or spinning the attenuated strand material to form yarn. The operating instrumentalities of a ring spinning machine are well known to persons skilled in the applicable technical arts, and the cooperation therewith of detectors moving with the traveling unit 11 for detecting broken yarns or "ends down" will be clear from the aformentioned related prior patents and the additional prior patents there referred to.

In order to monitor the conditions of ends of strand material normally being formed by a traversed machine 10, detectors (not shown) are mounted on the traveling unit 11 in accordance with the teachings of the aforementioned related United States patents. A data system is provided which is responsive to the detectors for determining the ends down condition of the traversed machine from the conditions of the monitored ends and may include other and further apparatus such as are disclosed in the related prior patent. As will be understood, the data system includes processor means which operatively communicate with sensor means for determining from signals received therefrom the operating conditions of respective ones of the machines and generating displays of an appropriate type.

Figure 3:
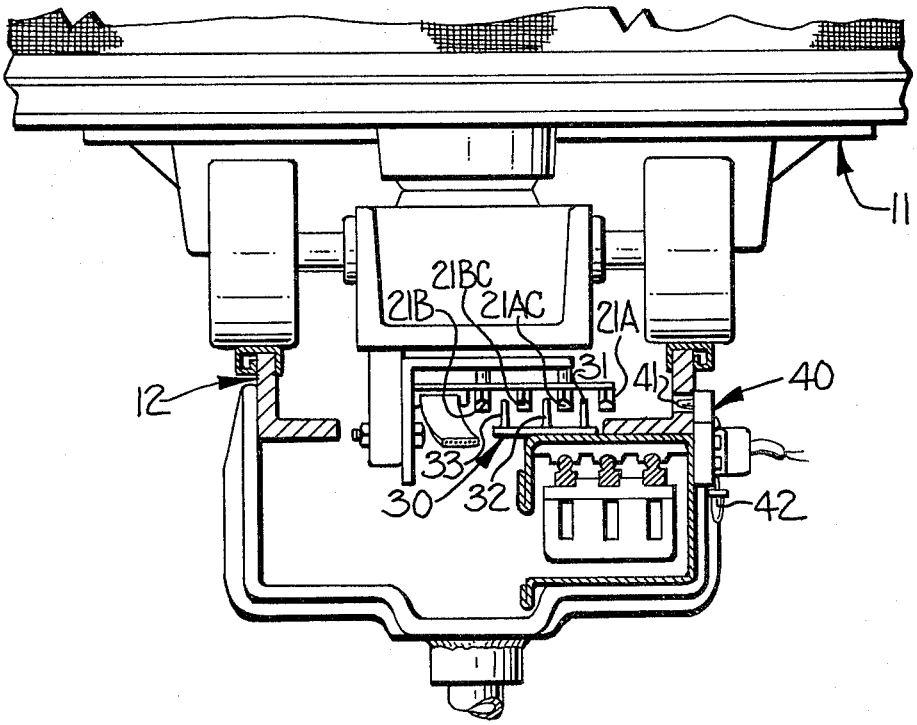
FIG. 3 is an enlarged elevation, partially in section, through a portion of the traveling unit and a supporting track as shown in FIG. 2.
Figure 4:
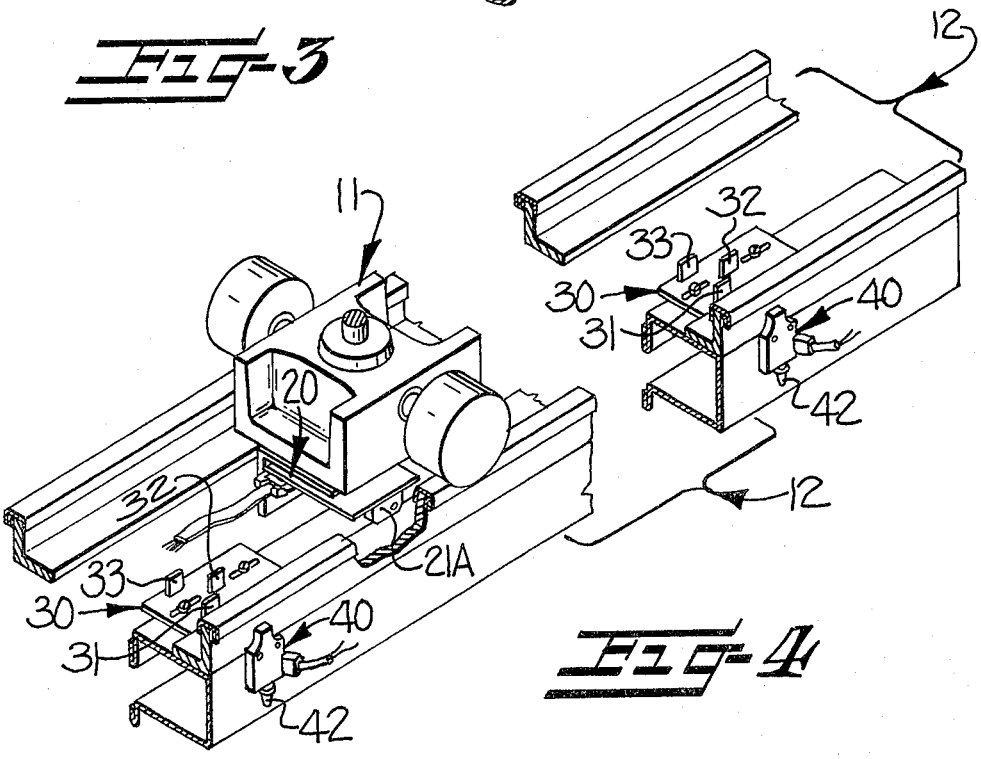
FIG. 4 is a perspective view, partially in section, of a portion of the track and apparatus of FIGS. 2 and 3.

In accordance with the present invention, identification detector means generally indicated at 20 is mounted on the traveling unit 11 for movement therewith and for originating and transmitting to the data system machine identification signals. The identification detector means comprises a plurality of electrical switch devices mounted in an array for scanning traversal of a corresponding plurality of paths. Preferably, and in the form illustrated, the identification detector means 20 comprises a plurality of sets of light sources in the form of light emitting diodes, and photoelectric devices, in the form of phototransistors, mounted in an array of depending divider members 21A, 21AC, 21BC, 21B. The divider members thus define (as visible in FIG. 3) three paths or channels therebetween, as pointed out more fully hereinafter.

Mounted in predetermined relation to a corresponding traversed machine 10 is an identification encoding means or encoder generally indicated at 30. As will be pointed out more fully hereinafter, the identification encoding means 30 is mounted for scanning traversal thereof by the detector means 20. Such scanning traversal will become more clear by reference to FIG. 3, where upstanding ribs 31, 32, 33 may be seen to be passed, somewhat in comb-like manner, through the channels defined between the depending portions of the detector means 20. The projecting ribs 31, 32, 33 of the encoder 30 function, in the preferred embodiment of the present invention, as light blocking elements which actuate the phototransistor electrical switch devices by blocking the receipt at the phototransistor of light emitted from the paired light emitting diode.

Figure 5:
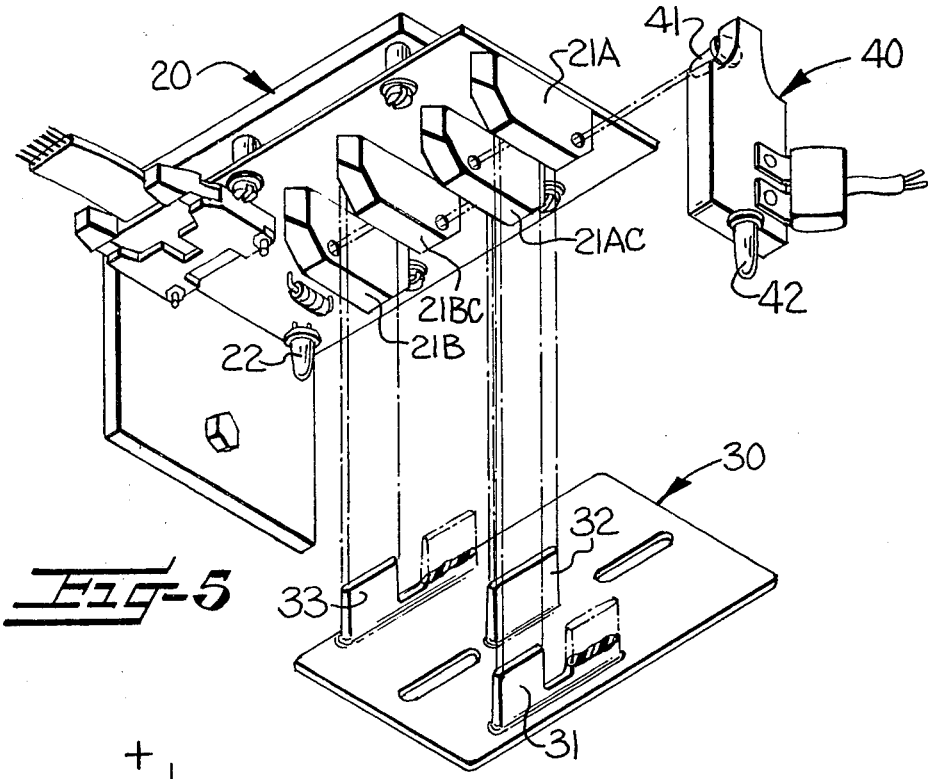
FIG. 5 is an unfolded perspective view of portions of the apparatus illustrated in FIGS. 3 and 4.

The encoder 30 is constructed so as to facilitate binary encoding of a signal which is uniquely correlated to a specific individual machine. More particularly, it will be noted that portions of the upstanding ribs of the encoder 30 in FIG. 5 are shown in phantom lines. As manufactured and before installation, each encoder 30 has a full complement of a center rib 32 of predetermined dimensions and a pair of outboard ribs at each of the indicated locations for the ribs 31, 33. Upon installation, predetermined selected ones, from none to all, of the portions of the outboard ribs 31, 33 are broken off or removed. By such selected removal, a signal is generated upon scanning traversal of the encoder 30 by the detector 20 which is uniquely correlated to a specific individual machine. As will be appreciated by persons knowledgeable in binary coding, the provision of four portions for the ribs 31, 33 opens the possibility of 16 different coded identifications.

It is to be noted that the ribs have a particular defined positional relationship. Further, the electrical switch devices actuated by the encoder 30 additionally have a particular positional relation one relative to another. As a consequence, the sequence of actuation of the switches with respect to the ribs is such as to permit generation of a signal indicative of the direction of movement of the traveling unit 11 relative to the specific individual machine 10 being identified. Thus, by appropriate logic circuitry, the direction of movement of the traveling unit 11 may also be distinguished.

The present invention further contemplates the inclusion of means for distinguishing between operating and nonoperating conditions of the spinning machine 10. That is, provision is made for mounting a frame power signal means generally indicated at 40, taking the form of a light emitting diode, in the track 11. By provision of a further light actuated transistor or appropriate photoelectric electrical switch device in the depending mounting portion 21A most closely adjacent the track 11, the illuminated or not illuminated condition of the frame power indicator 40 may be detected. Thus, if a particular spinning machine 10 is inoperative, the data system may be informed that no valid data will be derived from the identified machine as the traveling unit 11 begins traversal thereof.

As indicated in FIG. 2, it is preferred to provide a pair of encoding means or encoders 30 for each traversed ring spinning machine 10. One of each pair is mounted adjacent one end of the traversed machine (for example to the right in FIG. 2) with the other being mounted adjacent the other end thereof (for example to the left in FIG. 2). With such an arrangement, traversal of the machine in either direction of movement of the traveling unit 11 is accommodated.

Figure 6:
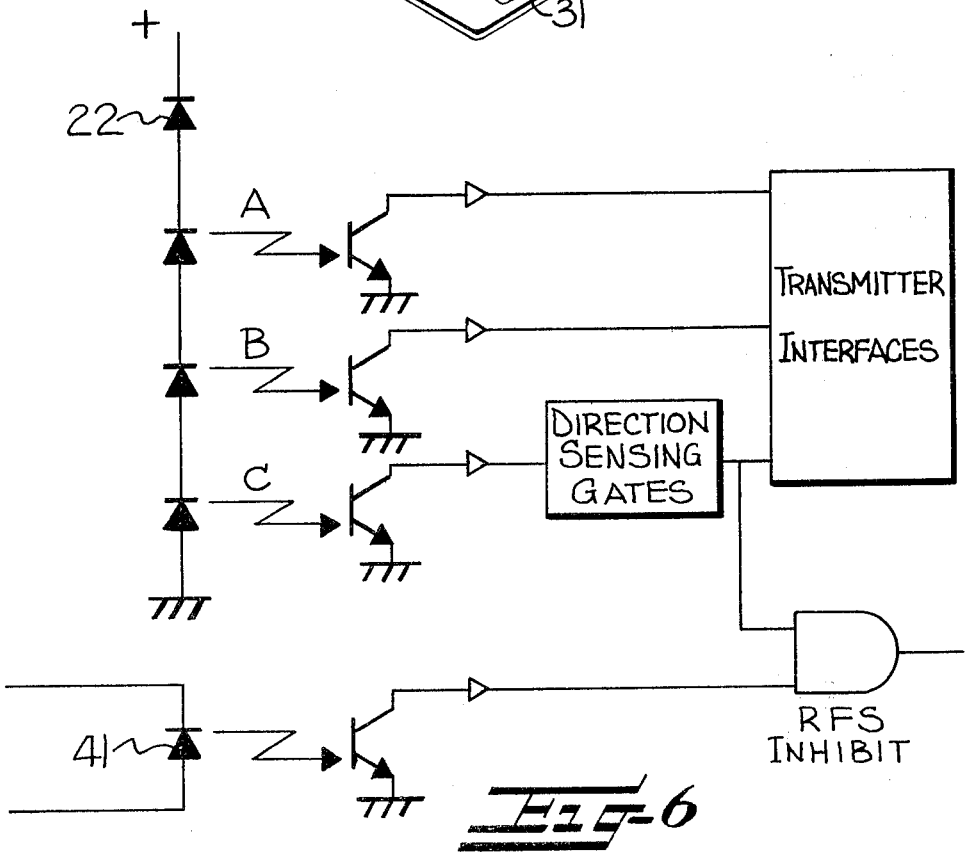
FIG. 6 is a schematic representation of circuitry incorporated in the apparatus of the present invention.

Generation of the identification signal results from the cooperation of the electrical switch devices with gate devices as will now be pointed out with particular reference to FIG. 6, where a schematic representation of the circuitry involved in the generation and transmittal of an identification signal is presented. As will be appreciated by persons skilled in the design and construction of electronic circuitry, the presentation there given is somewhat schematic. However, it is believed that such a representation of the circuit, together with the written disclosure to be found hereinabove and hereinafter, is sufficient to permit a person of ordinary skill in the applicable arts to design and construct a circuit which will function as now to be described. More particularly, if the outboard ribs 31, 33 of the encoder 30 are viewed as representing information channels A and B, with the intermediate rib 32 being viewed as representing information channel C, pairs of light emitting diodes and phototransistors as indicated may be provided for the respective channels. Additionally, an indicator light emitting diode 22 may be provided to indicate that power is available to the identification detector 20. The output from each of the phototransistors may be amplified in a suitable manner, with the output from information channels A and B provided essentially directly to a transmitter interface at least generally similar to that described in Saunders U.S. Pat. No. 3,680,298. Output from the channel C sensing the mid-rib 32 may be passed through an arrangement of direction sensing gates before reaching the transmitter interface.

By means of the frame power indicator generally indicated at 40 and an associated phototransistor, an appropriate signal may reach a suitable gate and, by cooperation with a signal derived from the identification detector 20, disable the operation of any interruption device such as described in Ford et al U.S. Pat. No. 3,726,072. Additionally, such a signal may be applied to invalidate any data otherwise captured from the frame being traversed, inasmuch as such data might be otherwise inaccurate. The frame power indicator includes one light emitting diode 41 directed toward a cooperating light actuated transistor as briefly described above. Additionally, and in order to provide for readily monitoring of the operation of the frame power indicator, a second warning light emitting diode 42 is mounted so as to be readily visible outside the track.

In the drawings and specification, there has been set forth a preferred embodiment of the invention, and although specific terms are employed, they are used in a generic and descriptive sense only and not for purposes of limitation.

That which is claimed is:

1. In apparatus for gathering information regarding the operating conditions of a group of ring spinning machines in a textile mill wherein at least one traveling unit is supported for travel along a predetermined path for traversing one or more of the machines with detectors mounted on the traveling unit for monitoring ends of strand material normally being formed by a traversed machine, and further wherein the apparatus has a data system responsive to the detectors on the traveling unit for determining the conditions of each machine of the traversed group of machines, an improvement in the data system which facilitates correlation of information gathered with a traversed machine, the improvement comprising:

identification detector means mounted on the traveling unit for movement therewith and for originating and transmitting to the data system machine identification signals, and identification encoding means mounted in predetermined relation to a corresponding traversed machine for scanning traversal of said encoding means by said detector means, said identification detector means and encoding means cooperating upon scanning traversal of said encoding means by said detector means for generating an identification signal uniquely correlated to a specific individual machine.

2. Apparatus according to claim 1 wherein said identification detector means comprises a plurality of electrical switch devices mounted in an array for scanning traversal of a corresponding plurality of paths and further wherein said identification encoding means comprises at least one switch actuating element mounted in alignment with a corresponding portion of said paths for actuating at least one of said electrical switch devices upon scanning traversal of said encoding means by said detector means.

3. Apparatus according to claim 1 wherein said identification detector means comprises a plurality of sets of light sources and photoelectric switch devices mounted in an array for scanning traversal of a corresponding plurality of paths and further wherein said identification encoding means comprises at least one switch actuating light-blocking element mounted in alignment with a corresponding portion of said paths for actuating one of said electrical switch devices upon scanning traversal of said encoding means by said detector means.

4. Apparatus according to one of claims 2 and 3 wherein said identification encoding means comprises a pair of encoding means for each traversed machine with one of said pair being mounted adjacent one end of a corresponding traversed machine and the other being mounted adjacent the other end thereof.

5. Apparatus according to claim 4 wherein each of said identification encoding means comprises a plurality of switch actuating elements mounted with respect to one another for activating a plurality of said electrical switch devices in a binary coded pattern.

6. Apparatus according to claim 4 wherein said identification detector means and encoding means cooperate for generating a signal indicative of the direction of movement of said traveling unit relative to said specific individual machine.

7. In a method of gathering information regarding the operating conditions of a group of ring spinning machines in a textile mill wherein one or more machines are traversed by at least one traveling unit supported for travel along a predetermined path while ends of strand material normally being formed by a traversed machine are monitored by detectors mounted on the traveling unit, and further wherein the condition of each machine is determined by a data system responsive to the detectors, an improvement which facilitates correlation of information gathered with a traversed machine, the improvement comprising:

scanning with an identification detector mounted on the traveling unit an identification encoder mounted in predetermined relation to a corresponding traversed machine, and generating in response to said scanning an identification signal uniquely correlated to a specific individual machine.

8. A method according to claim 7 wherein the step of generating a signal comprises actuating electrical switch devices in a predetermined pattern.

9. A method according to claim 8 wherein the step of generating a signal comprises selectively blocking along predetermined portions of the path the impingement of light onto a photoelectric switch device.

10. A method according to one of claims 8 and 9 wherein the step of scanning comprises scanning an identification encoder adjacent each of the opposite ends of a traversed machine.

11. A method according to claim 10 wherein the step of generating a signal further comprises actuating a plurality of electrical switch devices in a binary coded pattern.

12. A method according to claim 10 wherein the step of generating a signal further comprises coding the generated signal for indicating the direction of movement of the traveling unit relative to the traversed machine.

* * * * *